US006095355A

United States Patent [19]

Jessen et al.

[11] Patent Number: 6,095,355

[45] **Date of Patent: *Aug. 1, 2000**

[54] TAMPER EVIDENT SEAL FOR CONNECTOR TYPE CONTAINER ORIFICES

[75] Inventors: Claus Jessen, Nonnweiler; Franz Kugelmann, Usingen; Martin Lauer, Wendel; Ismael Rahimy, Altenstadt, all of Germany

[73] Assignee: Fresenius Medical Care Deutschland GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,777

[22] Filed: Jun. 4, 1997

[30] Foreign Application Priority Data

Jun. 5, 1996 [DE] Germany ..... 196 22 689

[51] Int. Cl.[7] ..... B65D 55/02

[52] U.S. Cl. ..... 215/247; 215/274; 215/DIG. 3

[58] Field of Search ..... 215/230, 247, 215/249, 274, 276, DIG. 3

[56] References Cited

U.S. PATENT DOCUMENTS

| | | | |
|---|---|---|---|
| 2,395,149 | 2/1946 | Shaw | 215/249 |
| 3,278,063 | 10/1966 | Kranzhoff | 215/249 X |
| 3,379,326 | 4/1968 | Andersen | 215/249 |
| 3,612,320 | 10/1971 | Wassilieff . | |

FOREIGN PATENT DOCUMENTS

| | | | |
|---|---|---|---|
| 360907 | 10/1922 | Germany . | |
| 1938093 | 4/1970 | Germany . | |
| 4204242 | 8/1983 | Germany . | |
| 397456 | 2/1966 | Switzerland | 215/230 |

*Primary Examiner*—Stephen K. Cronin
*Attorney, Agent, or Firm*—Kenyon & Kenyon

[57] ABSTRACT

The invention relates to a tamper evident seal for container orifices of the connector type, comprising a closure part. In accordance with the invention, on its bottom side, the closure part has an annular section, whose lower rim area is sealably retained in an annular gap formed in the opening area of the orifice.

14 Claims, 4 Drawing Sheets

TAMPER EVIDENT SEAL FOR CONNECTOR TYPE CONTAINER ORIFICES

FIELD OF THE INVENTION

The invention relates to a tamper evident seal for container orifices of the connector-type wherein the tamper evident seal comprises a closure part.

BACKGROUND INFORMATION

A tamper evident seal is understood to be a seal which can only be opened once and then not resealed, or which may be able to be resealed, but, in this context, does not retain its original sealed condition, so that once the seal has been opened, any subsequent sealing cannot go unnoticed. Tamper evident seals are preferably used for those containers where the user either wants to be certain or must be certain that he or she is opening it for the first time, in other words that he or she has a still originally sealed container with the contents intact. Therefore, tamper evident seals are used in particular for containers in the consumer goods industry, thus, for example, for food, cosmetics, detergents, and also motor oil. Tamper evident seals are also useful for containers used in laboratory science, for example, for preserving chemicals and samples, and containers for medical sciences, for example, containers for infusion solutions and dialyzing solutions.

The following types of tamper evident seals are known. Cut-off tip tamper evident seals, for example, as in silicon cartridges are known in the art. Typically cut-off tip tamper evident seals include a one-piece outflow connector that is sealed at one end. The connector is opened by cutting off the sealed end to expose the opening of a container.

The twisting break-off tip, e.g., as in blood-product pouches, is another type of tamper evident seal wherein a connector is formed in one piece and is sealed at one end by a section having a grippable pair of opposing twistable wings. The sealing section is joined by a concentrically disposed line of weakness to the tubular part of the connector, so that the connector can be opened by turning the grippable pair of wings such that the sealed section breaks off at the rupture joint formed by the line of weakness.

Partial break-off connectors have been used, for example, in transperitoneal dialysis pouches. In this type of tamper evident seal, the withdrawal connection of the pouch is comprised of a flexible tube into which is inserted a coupling piece of injection-molded plastic. A break-off plug projects out of the coupling piece into the tube, so that bending the tube causes the break-off plug to be broken off thereby releasing the contents of the container.

Still another type of tamper evident seal is a membrane that is capable of being pierced, e.g., as in solvent canisters. The connector is sealed by a membrane, which can be pierced by a tool, for example, by a screw-on cap having a point on the reverse side.

Tear tabs are known for use in drink cans. Such tear tabs include a predetermined breaking zone worked into the cover through formation of a circumferential line of weakness. The predetermined breaking zone is secured by a tab, so that the predetermined breaking zone is able to be released out of the cover when tensile stress is applied to the tab.

Pull-off seal membranes are known for use with food containers, e.g., yogurt containers. The membrane is secured circumferentially to the cover rim by what is known as a peelable seam. A portion of the membrane projects over the side and is used as a grip when tearing off the membrane.

Screw caps with perforated seal rings are known for use with, for example, drink bottles. Situated on the cover beneath the thread section of such a screw cap is a circumferential ring, which is joined by a perforation or another circumferential rupture joint to the cover. The ring grips with form locking in an undercut on the bottle neck. When the cover is unscrewed, the ring remains following separation of the rupture joint on the bottle neck.

Seal foil caps are known for use in, e.g., cognac bottles and water bottles. Placed over the screw-on or plug-type cover is a cap of tin or aluminum foil which is formed thereon, Another type of seal cap is a plastic sleeve which is shrunk into place. Typically, seal caps include initial tear spots or tear strips to facilate removal of the caps.

The strip seal is still another tamper evident seal known for use with, e.g., glass honey jars or tea bags. A strip-shaped piece of paper, which can be part of the label, is glued on so as to join the cover to the container and, upon removal of the cover, is torn.

SUMMARY OF THE INVENTION

The object of the invention is to create a tamper evident seal of the type indicated at the outset, which secures the container's tamper evident seal in a reliable and clearly recognizable manner until it is opened for the first time, and which frees a precisely defined opening cross-section without producing splinters from closure parts that have been broken or pulled off.

In the case of a tamper evident seal of the type mentioned at the outset, the present invention achieves this objective in that provision is made for the bottom side of the closure part to have an annular section, whose lower rim area is sealingly retained so as to pinch it in an annular gap formed in the opening area of the container.

When working with the closure part of the present invention, the annular section of the closure part is able to be pulled out of the annular gap to open the seal. After it has been pulled out, however, the annular section of the closure part is not able to be pushed into the annular gap again, so that once the seal has been opened, a renewed sealing with the closure part is impossible.

The closure part is expediently comprised of a plastic injection-molded part, so that the annular section of the closure part has a certain elastic deformability. As a general principal, once it is pulled off, the annular section is not able to be pressed into the annular gap again, because the wall of the annular section spreads or bulges, and because there is hardly a chance that the bottom rim of the annular section will exactly meet the annular gap, if the attempt is made to restore the seal.

To rule out with certainty any chance of the annular section being able to be pressed into the annular gap again, one preferred specific embodiment of the invention provides for the annular section to widen or narrow conically toward its bottom rim and to be retained in an annular gap of the opening area having a form substantially complementary to the rim portion. Once it is opened the first time, the seal is not able to be restored, because the annular section of the closure part meets with the edge area either of the part delimiting the outer edge or the inner edge of the annular gap, so that any pressing of the annular section into the annular gap is ruled out.

In the case of the tamper evident seal of the present invention, the closure part is retained with a press fit at or in the area of the connector-type orifice of the container, with a certain elastic deformation of its peripheral section or of one edge or of both edges of the annular gap, so that the entire opening cross-section of the container is exposed when the closure part is pulled off. Since the closure part is retained with a press fit with its peripheral section between the edges of the annular gap, no fragments or splinters, which could contaminate the contents of the container, are produced when the closure part is pulled off. Since before it is opened, the closure part is retained in a position where its peripheral rim is retained with a press fit, after it is pulled out, it is no longer able to be pushed back into the squeezed position, so that the person opening the closure is no longer able to produce the press fit.

With its annular peripheral section, the closure part can grip from behind one section of the inner side of the opening area of the orifice or an annular spacer piece connected thereto, the diameter of the peripheral section of the closure part being greater than the inner diameter of the section that is gripped from behind. Thus, in this specific embodiment, a peripheral section of the closure part is retained squeezingly on the inside of the orifice, the means exerting the gripping pressure on the peripheral section being of any desired type.

Preferably, the closure part according to the present invention has a cap or hat-shaped form.

Provision can be made for the cap-shaped closure part to have a conically widened circumferential wall, by way of which it adjoins a complementary inner conical section of the opening area. Here as well, any suitable means can be used for retaining the rim of the circumferential wall of the closure part with a press fit on the inner conical section of the opening area.

Provision is made in accordance with a further embodiment of the invention for an annular insertion part together with one section of the opening area to define the rim or the inner circumferential wall of the annular gap squeezing the closure part.

The rim or the inner circumferential wall of the closure part can also be fixed in an annular gap, which is formed between the outer circumferential wall of one section of the opening area and a retaining ring surrounding the same.

One preferred specific embodiment provides for the circumferential rim of the cap-shaped closure part to be wedged between an inner, conical opening rim of a sleeve-shaped retaining ring joined to a connecting tubular piece and a spacer ring, overlapped by the recessed edge of said spacer ring and having a radial closure wall of elastomeric material. After the closure part is pulled off, the closure wall can be pierced by a stick pin, which is retained on the spacer ring.

The spacer ring can have an outer section, which is recessed by a circumferential annular collar and which, together with the inner conical opening rim, forms a gripping annular gap. In this context, the recessed section can also have a conical shape.

The spacer ring is expediently gripped between the indented rim of the retaining ring and the front end or a front-end step of the tubular piece.

In one embodiment of the invention, provision is made for a screw cap to be placed on the spacer ring or the orifice, said screw cap having a middle cut-out that is delimited by an annular step, the conical or cap-shaped closure part being braced against said middle cut-out with a more or less complementary annular step. When the screw cap is unscrewed or removed, the closure part is also pulled off along with it, freeing the opening cross-section.

The annular section is expediently integrally formed with the screw cap, so that said screw cap constitutes the closure part.

The screw cap can overlap the retaining ring with a cylindrical peripheral section and be braced via an inner, annular step having sections rising axially in a wedge or curve shape against more or less complementary sections of an outer annular step of the retaining ring or of the orifice. Thus, turning the closure part by a small angle pulls it out of its press fit and removes it together with the screw cap. The closure could also be opened simply by tilting the screw cap.

Provision is made in another embodiment of the present invention for the closure part to also be comprised of a flat or convex disk, as shown respectively in FIGS. 3 and 4, whose rim is retained with a press fit in an inner groove of the opening area section. The disk can be provided with a nipple or extension 150 to facilitate its removal upon the first opening.

Another embodiment of the invention provides for the cap-shaped closure part to be provided with a circumferential annular enlarged rim to retain it with a press fit in an annular groove of the opening area section.

The tamper evident seal of the present invention is able to be manufactured from simple injection-molded plastic parts. The seal can be automatically and simply assembled, which will be described again on the basis of an exemplary embodiment. One cannot outsmart the seal by returning it to its original sealed state, once it has been opened the first time. The tamper evident seal of the present invention remains impervious before, during and after a steam or hot water sterilization, which is especially significant when sterile substances are stored in the container sealed by said seal. If, for example, the tamper evident seal of the present invention is used, for example, to seal off containers containing infusion solutions, it envelopes the spacer ring having a radial closure wall (septum) in a sterile and impervious manner until it is opened.

It is easy for the user to understand how to open the seal of the present invention, so that there is no need to study directions.

DETAILED DESCRIPTION

Figure 1:
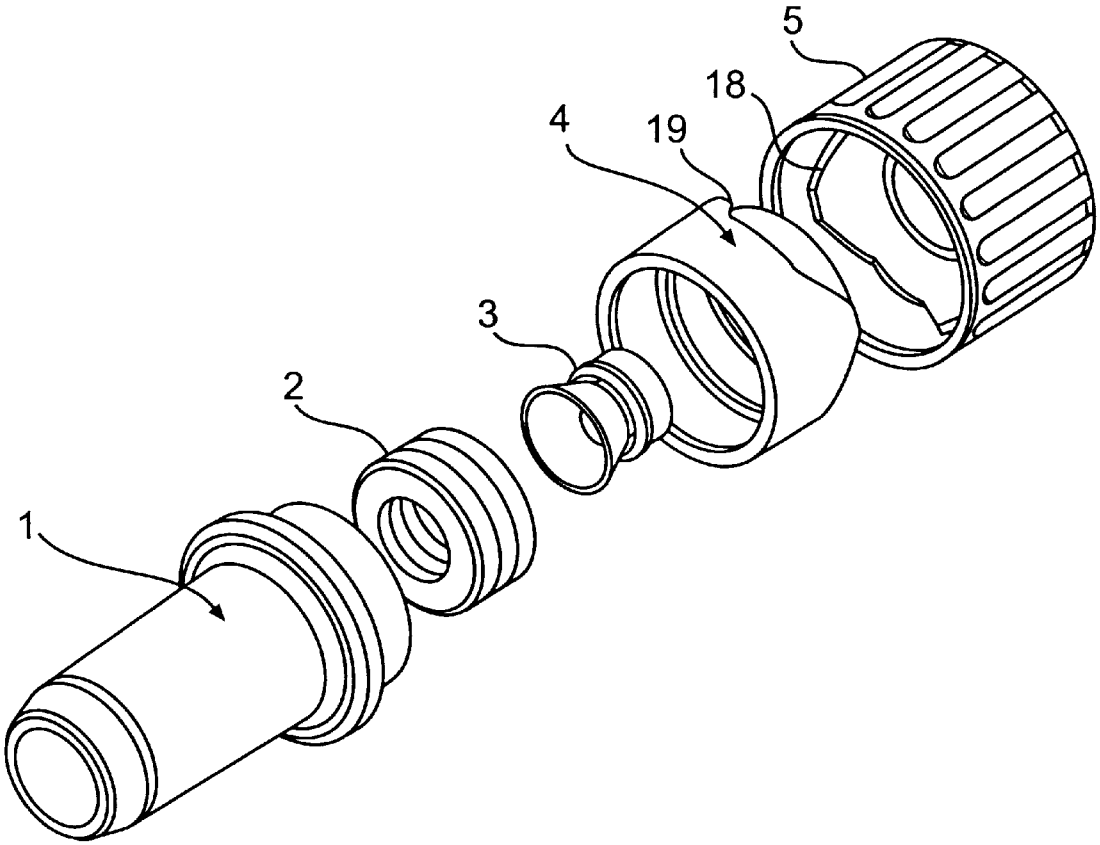
FIG. 1 shows an exploded view of the individual parts of the tamper evident seal according to the present invention in a perspective view.
Figure 2:
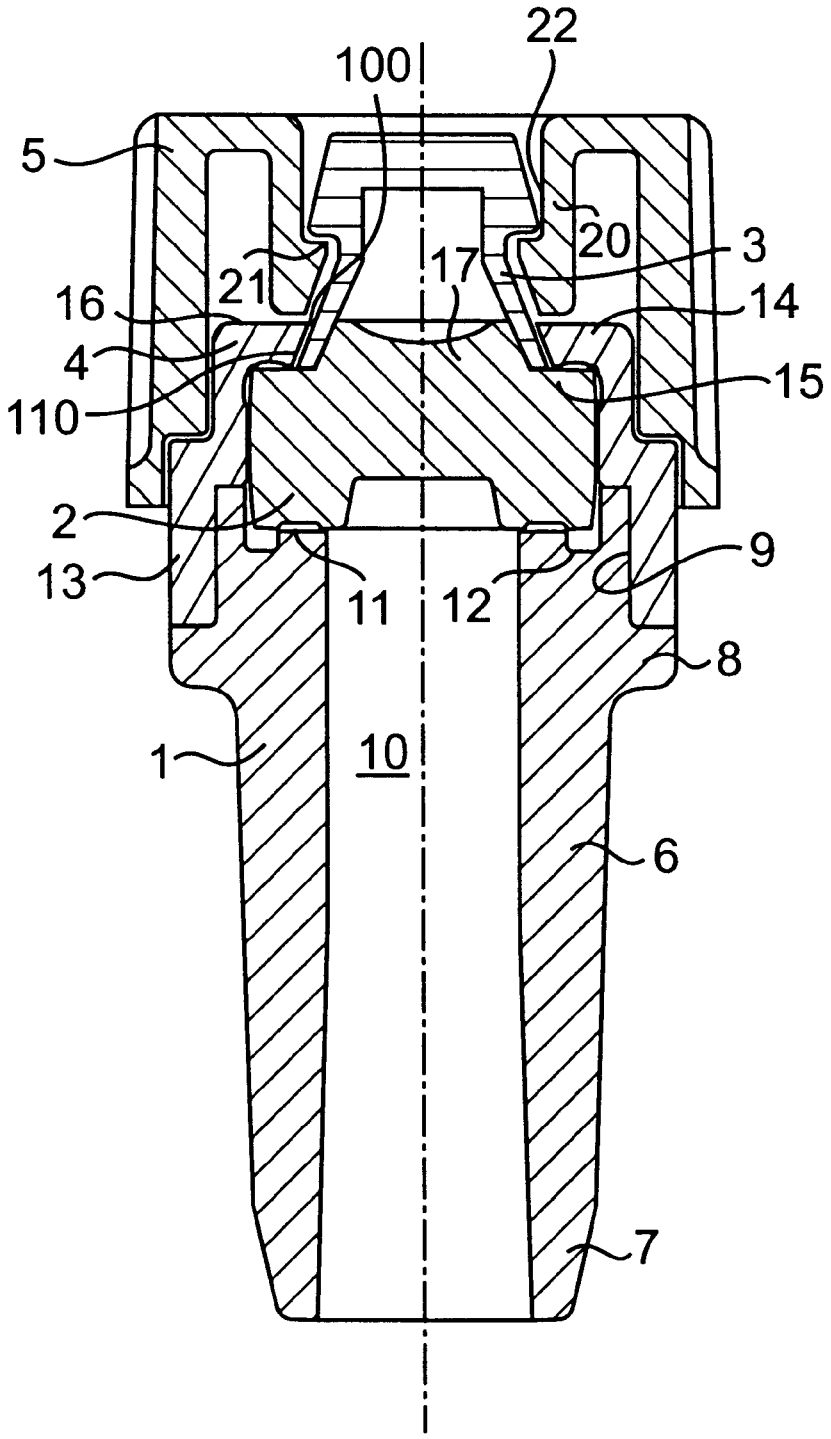
FIG. 2 shows a longitudinal section through the tamper evident seal according to the present invention.
Figure 3:
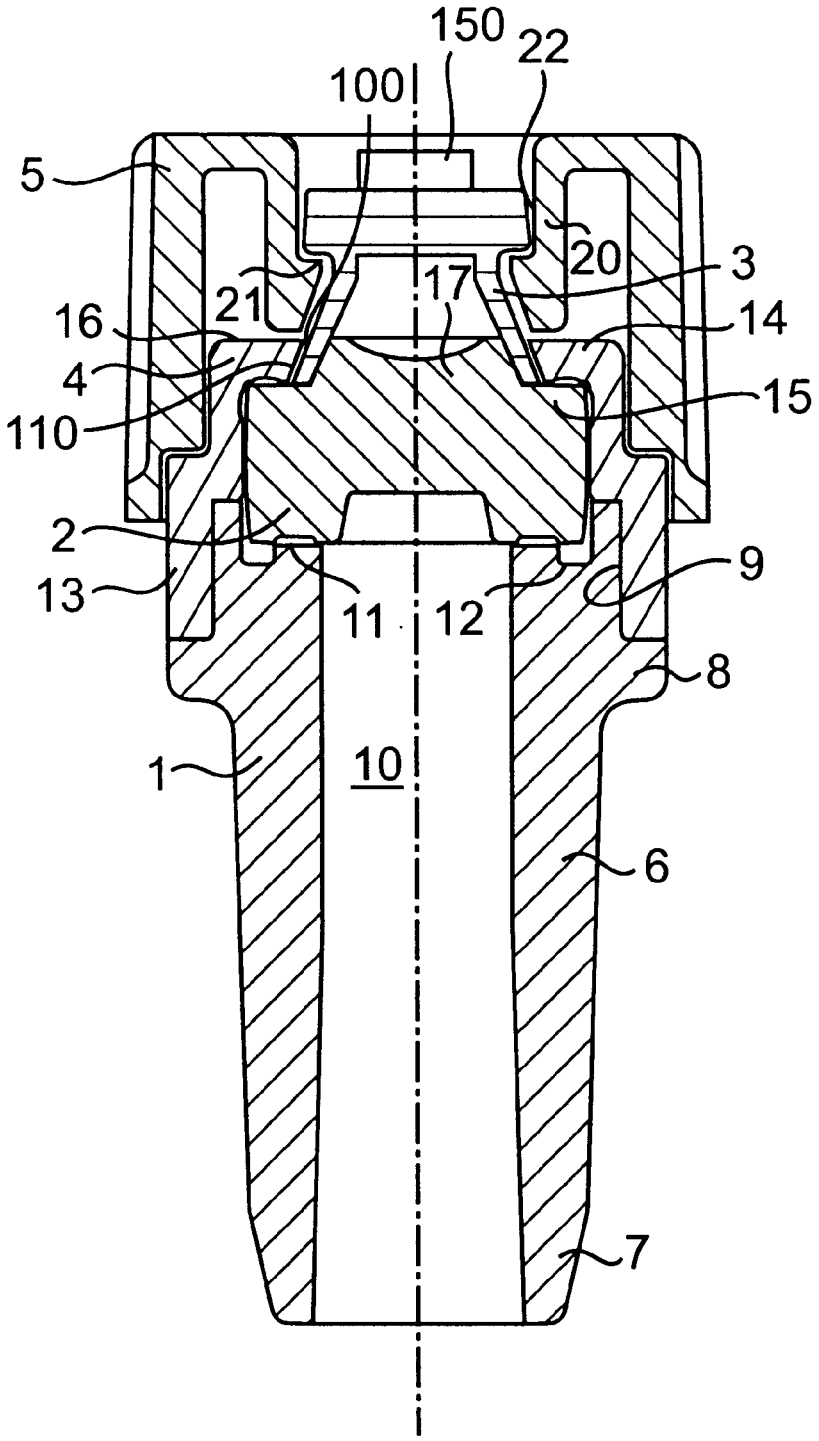
FIG. 3 shows a second embodiment of the invention.
Figure 4:
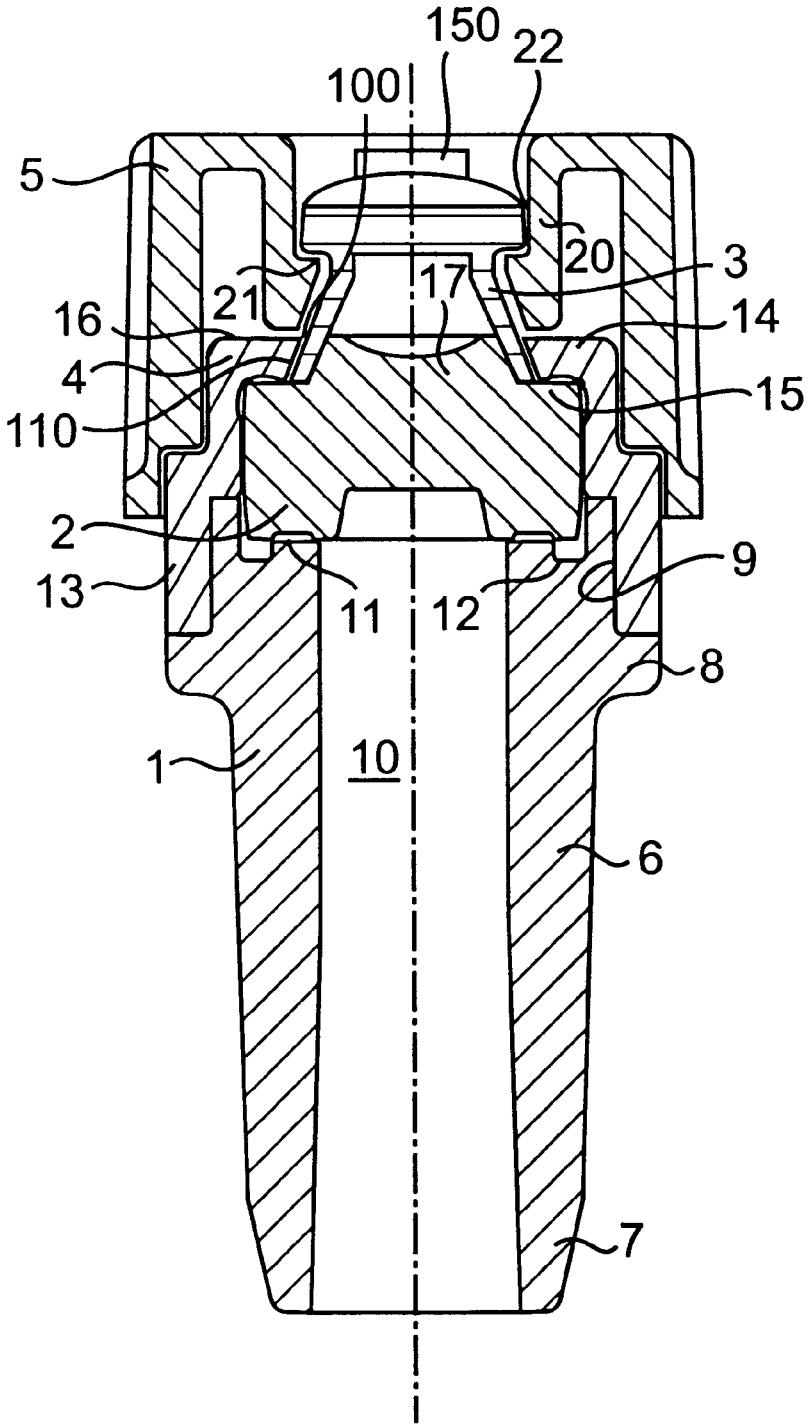

The exemplary embodiment of the tamper evident seal of the invention is comprised of a connecting tubular piece 1, on which is retained a spacer ring 2 of elastomeric material having a radial closure wall by means of a sleeve-shaped retaining ring 4 of plastic Sleeve-shaped retaining ring 4 is provided with a recessed rim, which surrounds a section recessed from retaining ring 4 by an annular collar and which, with said section, defines an annular gap, in which the bottom rim of cap-shaped closure part 3 of plastic is retained with a press fit. Placed upon the retaining ring is a screw cap 5, which has a middle cut-out that is delimited by an annular step. Cap-shaped closure part 3 is braced against said annular step with a more or less complementary annular step, as will be described in greater detail in the following.

Connecting tubular piece 1 comprised of an injection-molded plastic part has a slightly conically tapered shaft part 6, which is adjoined by a lower section 7 having a more conical angle. The slightly conical shaft part 6 is upwardly delimited by a collar 8. Above said collar 8, connecting tubular piece 1 has an upper section 9, which is slightly conical toward the outside. At its upper end, through-hole 10 of the connecting tubular piece has a widened area formed by an annular step, an inner part 11 of the annular step being divided off from the circumferential wall by an axial annular groove 12. Outer section 9 of connecting tubular piece 1 is overlapped by an annular section 13 of sleeve-type retaining ring 4 that is widened over an inner annular step. Sleeve-type retaining ring 4 is likewise comprised of an injection-molded plastic part and is welded to connecting tubular piece 1.

Spacer ring 2 with its septum is comprised of an elastomer and is gripped between annular step 11 of connecting piece 1 and indented rim 14 of the sleeve-type retaining ring, which overlaps an upper annular step 15 of spacer ring 2. The elastic gripping is illustrated by showing spacer ring 2 in cross-section with the parts of connecting tubular piece 1 and of sleeve-type retaining ring 4 gripping said spacer ring 2.

Closure part 3 is comprised of a plastic injection-molded part and, on its bottom side, has a conically shaped annular section 16. The bottom, conical edge area of section 16 of cap-shaped closure part 3 is gripped with a press fit between the inner conical inside wall of indented rim 14 of retaining ring 4 and recessed section 17 of the spacer ring having a conical circumferential rim, the press-fit gripping being depicted by the overlapping section. Screw cap 5 is likewise comprised of an injection-molded plastic part and, on the inner side of its inner circumferential wall, has an inner annular step 18 with sections rising axially in a wedge or curve shape. Screw cap 5 is braced by way of its annular step 18 against more or less complementary sections of an outer annular step 19 of retaining ring 4.

Screw cap 5 having outer axial ribs is provided with an inner, tubular-section-shaped indentation 20, which is provided at its opening rim with a radial annular step 21. Cap-shaped closure part 3 is braced with a complementary annular step 22 against said annular step 21, the bracing between the two annular steps 21, 22 being shown in overlapping section.

Connecting tubular piece 1 of the tamper evident seal forms the connection to the closure part of a container, for example to a plastic pouch for infusion solutions having a tubular connection heat-sealed thereto. After the pouch is filled through this tubular connection, the already completely assembled tamper evident seal is inserted with its tubular connecting piece 1 into the tubular connection, so that following sterilization, a permanent and impervious connection is formed. Of course, tubular connecting piece 1 can also be welded together with the tubular connection of the plastic pouch. Other connection techniques are possible.

The septum formed by spacer ring 2 having a radial closure wall is comprised of an elastomer and turns the depicted tamper evident seal into what is known as a septum connector. During use, the septum is pierced with a cannula and, in this context, reseals the connection between the connector and the cannula. After the cannula is pulled out, the septum closes the connector again.

Spacer ring 2 containing the septum is, as already described, gripped with elastic deformation between tubular connecting piece 1 and sleeve-type retaining ring 4. The sealing action produced by the elastic deformation is retained due to the heat resistance of the elastomer, even in the case of a steam or hot water sterilization. In the manner described, together with indented rim 14 of retaining ring 4, spacer ring 2 forms a squeezing sealing gap for the bottom rim of cap-shaped closure part 3. This brings about the advantage in laboratory and medical technology applications that the part of the septum that is exposed after the seal is opened, remains clean and sterile during storage of the container without requiring any additional protective packaging or even when defective protective packaging is used.

To assemble the tamper evident seal, cap-shaped closure part 3 is first inserted into retaining ring 4 in the manner that the bottom, conical rim area of annular section 16 adjoins the inner conical rim of the indented end part of retaining ring 4. Spacer ring 2 is then inserted, so that the bottom, conical edge area of annular section 16 is gripped in the annular gap formed by the edges of retaining ring 4 and of spacer ring 2. Retaining ring 4 is then joined to tubular connecting piece 1. Screw cap 5 is subsequently pressed on and annular collars 21, 22 grip one another from behind with their saw-tooth profiles making a snap-fit connection.

Retaining ring 4 can be joined to the tubular connecting piece by means of heat sealing, or also through bonding, shrink-fitting, snap-fitting, or screw fitting. If a snap-in screw connection having an integrated rotary lock is provided, the special benefit is attained of being able to use the tamper evident seal as a sample-collection container, as the closure can also be effected by hand.

The tamper evident seal of the present invention is a seal which cannot be outsmarted and which can be recognized with certainty in its original sealed state.

Special advantages that the tamper evident seal of the present invention has over tamper evident seals having break-off or tear-off parts is that there is no need to dimensionally design rupture joints that in some instances can only be broken through with difficulty, and that there is no need to observe narrow material or manufacturing tolerances necessitated by correctly functioning rupture joints. Finally, in the case of the tamper evident seal of the present invention, there are also no splintered-off small parts, which could contaminate the contents of the containers.

It is easy to discern how to open the tamper evident seal of the present invention, which is not always the case, for example, when working with seals having sealed-on membranes, tear tabs, tear strips, or initial tear spots, because the points of application are difficult to find, difficult to grip, or difficult to actuate. It also happens often enough that tear tabs break off, so that considerable efforts have to be expended to open the seal.

The tamper evident seal of the present invention is able to be opened without the use of additional tools, which would usually have to be supplied with seals having separating membranes.

What is claimed is:

1. A tamper evident seal for sealing an orifice, the tamper evident seal comprising:

a retaining ring;

a closure portion having a step-like section and a conical annular section, the annular section of the closure portion including a rim portion, wherein the rim portion is capable of being sealably retained in an annular gap situated in an opening area of an orifice, the annular gap being delimited by a surface of the retaining ring and at least one of an outer side of the opening area and an annular spacer ring connected to the opening area; and a screw cap extending over the retaining ring, the screw cap having a second step-like section overlapped by the step-like section.

2. The tamper evident seal according to claim 1, wherein the spacer ring forms an inner circumferential wall of the annular gap in which the closure portion is capable of being sealably retained.

3. The tamper evident seal according to claim 1, wherein the closure portion has a truncated cylinder form.

4. The tamper evident seal according to claim 1 wherein a rim diameter of the conical annular section of the closure portion is larger than the diameter of the at least one of the outer side of the opening area of the orifice and a recessed section of the annular spacer ring.

5. The tamper evident seal according to claim 4, wherein the conical annular section of the closure portion includes a circumferential wall for adjoining an inner conical wall of the retaining ring opening area, the inner conical wall being substantially complementary to the circumferential wall.

6. The tamper evident seal according to claim 1 wherein the retaining ring is sleeve-shaped and the rim portion of the annular section of the closure portion is capable of being sealably retained between an inner conical section of the sleeve-shaped retaining ring, the sleeve-shaped retaining ring being joined to a tubular connecting element and the spacer ring, the spacer ring having a radial closure wall of elastomeric material, the sleeve-shaped retaining ring including an indented edge substantially complementary to an outer wall of the spacer ring.

7. The tamper evident seal according to claim 6, wherein the spacer ring is retained between the indented edge of the retaining ring and a first end of the tubular connecting element.

8. The tamper evident seal according to claim 6, further comprising a screw cap extending over the retaining ring, wherein the screw cap includes an inner annular step, the screw cap being braced by the inner annular step against substantially complementary sections of an outer annular step of the retaining ring.

9. The tamper evident seal according to claim 6, wherein the spacer ring includes a circumferential annular collar forming a recessed outer section of the spacer ring, the recessed outer section of the spacer ring and the inner conical section of the retaining ring forming the annular gap.

10. The tamper evident seal according to claim 9, wherein the recessed outer section of the spacer ring has a conical shape.

11. A tamper evident seal for sealing an orifice comprising:

a retaining ring;

a screw cap; and a closure portion separable from the screw cap and connected to the screw cap wherein the closure portion is comprised of one of a flat or convex disk including a rim portion capable of being sealably retained in an inner groove being delimited by a surface of the retaining ring and an annular spacer ring.

12. The tamper evident seal according to claim 11, wherein the disk includes an extension member to facilitate its removal.

13. A tamper evident seal for sealing a container comprising:

a retaining ring;

a spacer ring separable from the container;

a closure portion wherein the closure portion has a cap shape and is provided with a circumferential annular bulge to sealably retain it in an annular groove of an opening area of an orifice, the annular groove being delimited by the retaining ring and the spacer ring, and a screw cap extending over the retaining ring, the screw cap having a step-like section overlapped by the annular bulge.

14. A tamper evident seal for sealing a container orifice, the tamper evident seal comprising:

a closure portion having a conical annular section at a first end of the closure portion, the annular section of the closure portion including a rim portion wherein the rim portion is capable of being sealably retained in an annular gap formed between an opening area of a container orifice and a retaining ring surrounding the opening area, the annular gap having a form substantially complementary to the annular section of the closure portion;

a tubular connecting element and an annular spacer ring joined to the retaining ring; and a screw cap extending over the retaining ring, the screw cap including a screw cap orifice in which the closure portion is sealably retained.

* * * * *